US007677013B2

(12) United States Patent
Nagano et al.

(10) Patent No.: US 7,677,013 B2
(45) Date of Patent: Mar. 16, 2010

(54) SPOUT INSTALLATION METHOD AND SPOUT INSTALLATION DEVICE

(75) Inventors: Satoshi Nagano, Sakai (JP); Tsuyoshi Wada, Sakai (JP)

(73) Assignee: Fuji Seal International, Inc., Osaka-shi (JP)

( * ) Notice: Subject to any disclaimer, the term of this patent is extended or adjusted under 35 U.S.C. 154(b) by 473 days.

(21) Appl. No.: 11/642,901

(22) Filed: Dec. 21, 2006

(65) Prior Publication Data

US 2007/0105698 A1 May 10, 2007

Related U.S. Application Data

(63) Continuation-in-part of application No. PCT/JP2005/011245, filed on Jun. 20, 2005.

(30) Foreign Application Priority Data

Jun. 25, 2004 (JP) ..... 2004-188004

(51) Int. Cl.
*B65B 61/20* (2006.01)

(52) U.S. Cl. ..... 53/133.2; 53/422; 493/87

(58) Field of Classification Search ..... 52/133.2, 52/133.1, 410, 422; 493/87, 121, 213, 214
See application file for complete search history.

(56) References Cited

U.S. PATENT DOCUMENTS 6,045,493 A * 4/2000 Totani ..... 493/201
6,145,275 A * 11/2000 Sweeney ..... 53/412
6,676,585 B1 * 1/2004 Stahlecker et al. ..... 493/87
7,090,630 B2 * 8/2006 Boldrini et al. ..... 493/51

FOREIGN PATENT DOCUMENTS

JP 9-262914 A 10/1997
JP 10-323920 A 12/1998
JP 2003-311851 A 11/2003

* cited by examiner

*Primary Examiner*—Sameh H. Tawfik
(74) *Attorney, Agent, or Firm*—Westerman, Hattori, Daniels & Adrian, LLP

(57) ABSTRACT

A rotary type pouch reception/delivery unit is configured to receive a pouch supplied by a pouch supply unit at a pouch reception/delivery position α, conveys it to a pouch reception/delivery position β, and delivers it to a spout installation unit at a pouch reception/delivery position β. The pouch reception/delivery unit is provided with a plurality of take-up members rotating at a constant rotation speed so as to pass the pouch reception/delivery position α and a pouch reception/delivery position β. The pouch reception/delivery unit receives the pouch supplied in a standing state at the pouch reception/delivery position α by sucking and holding it by a take-up member and tilts the pouch during conveyance. At the pouch reception/delivery position β, the pouch receipt/delivery unit delivers the pouch to the spout installation device with a spout installation edge portion horizontally tilted.

5 Claims, 8 Drawing Sheets

SPOUT INSTALLATION METHOD AND SPOUT INSTALLATION DEVICE

RELATED APPLICATIONS

This application is a Continuation-In-Part of International Patent Application No. PCT/JP2005/011245 filed on Jun. 20, 2005. This application claims priority under 35 U.S.C. §119 to Japanese Patent Application No. 2004-188004 filed on Jun. 25, 2004. The entire disclosures of each of these applications are incorporated herein by reference in its entirety.

BACKGROUND OF THE INVENTION

1. Field of the Invention

The present invention relates to a spout installation method and a spout installation apparatus for installing a spout to a pouch.

2. Description of Related Art

The following description sets forth the inventors' knowledge of related art and problems therein and should not be construed as an admission of knowledge in the prior art.

For example, as shown in FIG. 7A, in a pouch container SP1 with a spout to which a spout S1 serving as a tap or a pouring mouth is installed to the upper edge portion UE of the pouch P1 having a side gusset portion formed by a flexible sheet made of, e.g., a synthetic resin film, a pouch P1 having a non-heat-sealed upper edge portion UE is preliminarily manufactured, and then, after inserting a spout S1 into the opened upper edge portion UE of the pouch P1 as shown in FIG. 7B, the spout S1 is installed to the pouch P1 by heat sealing the upper edge portion UE. Such spout installation work is performed by, for example, a spout installation apparatus 50 as shown in FIG. 8. The shaded portion in FIGS. 7A and 7B denotes a heat sealed region of the pouch P1.

As shown in FIG. 8, the aforementioned spout installation apparatus 50 is provided with a spout supply unit 51 for sequentially supplying a spout S1 by conveying it, a pouch supply unit 52 for sequentially supplying a pouch P1 with a non-heat-sealed upper edge portion UE, a rotary type spout installation portion 53 provided with a plurality of spout installation heads, and a discharge unit 54 for sequentially discharging a pouch container SP1 with a spout formed by the spout installation portion 53. The spout installation unit 53 is configured to insert the spout S1 supplied from the spout supply unit 51 to the upper edge portion UE of the pouch P1 supplied from the pouch supply unit 52 and then heat seal the upper edge portion UE of the pouch P1 to thereby form the pouch container SP1 with a spout. The pouch supply unit 52 is configured to deliver the pouch P1 in a standing state such that the non-heat-sealed upper edge portion UE of the pouch P1 faces upward.

Each spout installation head of the spout installation unit 53 is provided with a spout clamper for holding a portion of a spout S1 between the upper and lower flange portions with a pair of holding arms, a pouch holder for sucking and holding both the front and rear surfaces of the pouch P1 with a pair of sucking and holding arms disposed at a lower side of the spout clamper, and a heat sealer having a pair of seal bars disposed between the spout clamper and the pouch holder. Thus, while conveying the spout S1 held by the spout clamper and the pouch P1 sucked and held by the pouch holder at the lower side of the spout S1 on the same conveyance line, the upper edge portion UE of the pouch P1 is opened by opening the pair of sucking and holding arms sucking and holding both the front and rear surfaces of the pouch P1, and then the sucking and holding arms are raised to insert the spout S1 into the opened upper edge portion UE of the pouch P1, and the upper edge portion UE is heat sealed by the heat sealer. (see, e.g., Japanese Unexamined Laid-open Patent Publication No. 2003-311851, and Japanese Unexamined Laid-open Patent Publication No. H06-48401)

As such a pouch container with a spout, other than the aforementioned pouch container with a spout installed to the upper edge portion of the pouch, for example, there is a pouch container in which a spout S is installed to the angled side edge portion (spout installation edge portion) SE as shown in FIG. 9A. In the aforementioned spout installation apparatus 50, however, it is not considered to obliquely install a spout S to a non-heat-sealed spout installation portion SE of a pouch P. Therefore, a spout S cannot be installed to the angled side edge portion SE of the pouch P. The shaded portion in FIGS. 9A and 9B denotes a heat sealed region of the pouch P1.

On the other hand, Japanese Unexamined Laid-open Patent Publication No. H06-48401 discloses an automatic filling-packing system in which a spout is installed to an angled side edge portion of a pouch in a standing state. This automatic filling-packing system is configured to intermittently perform various processing, such as, (a) supplying a pouch with a non-heat-sealed upper edge portion, (b) cutting the upper end corner portion of the pouch, (c) inserting a spout into the angled side edge portion formed by the cutting, (d) heat sealing the angled side edge portion in which the spout is inserted, (e) forming a filling opening for filling contents, (f) filling of contents, (g) heat sealing the filling opening, and (h) discharging a pouch container with a spout filled with contents, respectively, at each station. Therefore, there is a problem that this system is not suitable for high-speed processing.

The description herein of advantages and disadvantages of various features, embodiments, methods, and apparatus disclosed in other publications is in no way intended to limit the present invention. For example, certain features of the preferred embodiments of the invention may be capable of overcoming certain disadvantages and/or providing certain advantages, such as, e.g., disadvantages and/or advantages discussed herein, while retaining some or all of the features, embodiments, methods, and apparatus disclosed therein.

SUMMARY OF THE INVENTION

The preferred embodiments of the present invention have been developed in view of the above-mentioned and/or other problems in the related art. The preferred embodiments of the present invention can significantly improve upon existing methods and/or apparatuses.

Among other potential advantages, some embodiments can provide a spout installation method capable of installing a spout to a vertical or angled side edge portion of a pouch and suitable for high-speed processing.

Among other potential advantages, some embodiments can provide a spout installation apparatus capable of installing a spout to a vertical or angled side edge portion of a pouch and suitable for high-speed processing.

According to a first aspect of a preferred embodiment of the present invention, a spout installation method for installing a spout to a side edge portion of a pouch, the side edge portion being vertical or angled, comprises the steps of:

tilting the pouch such that a spout installation edge portion of the side edge portion lies substantially horizontal;

opening the spout installation edge portion while the pouch is tilted such that the spout installation edge portion lies substantially horizontal, and inserting the spout into the spout installation edge portion; and heat sealing the spout to the spout installation edge portion.

In the spout installation method, the pouch is tilted from a standing state to a state in which the spout installation edge portion of the side edge portion lies substantially horizontal.

According to a second aspect of a preferred embodiment of the present invention, a spout installation apparatus comprises:

a pouch supply unit;

a pouch reception/delivery unit; and a spout installation unit, wherein the spout installation apparatus delivers a pouch from the pouch supply unit via the pouch reception/delivery unit to the spout installation unit, wherein the pouch has a spout installation edge portion on a vertical or angled side edge portion where a spout is installed, wherein the spout installation unit installs the spout to the pouch, and wherein the pouch reception/delivery unit receives the pouch in a standing state and delivers the pouch to the spout installation unit with the pouch being tilted such that the spout installation edge portion lies substantially horizontal.

It is preferable that the spout installation unit is a rotary type unit for installing the spout to the pouch while conveying the pouch with a bottom portion of the pouch protruded radially outward.

It is preferable that the pouch reception/delivery unit is a rotary type unit equipped with a plurality of take-up members each for holding the pouch, and the take-up member is configured to swing by a swing mechanism as the pouch reception/delivering unit rotates to thereby tilt the pouch held by the take-up member.

It is preferable that the pouch reception/delivery unit delivers the pouch held by the take-up member tilted by the swing mechanism to the spout installation unit.

According to another aspect of a preferred embodiment of the present invention, a spout installation apparatus comprises:

a pouch supply unit;

a pouch reception/delivery unit; and a spout installation unit, wherein the spout installation apparatus delivers a pouch from the pouch supply unit via the pouch reception/delivery unit to the spout installation unit, the pouch having a spout installation edge portion on a vertical or angled side edge portion where a spout is installed, wherein the spout installation unit installs the spout to the pouch, and wherein spout installation unit receives the pouch in a standing state and tilts the pouch such that the spout installation edge portion lies substantially horizontal before installing the spout to the pouch.

According to another aspect of a preferred embodiment of the present invention, a spout installation apparatus comprises:

a pouch supply unit;

a pouch reception/delivery unit; and a spout installation unit, wherein the spout installation apparatus delivers a pouch from the pouch supply unit via the pouch reception/delivery unit to the spout installation unit, the pouch having a spout installation edge portion on a vertical or angled side edge portion where a spout is installed, wherein the spout installation unit installs the spout to the pouch, and wherein the pouch supply unit supplies the pouch to the pouch reception/delivery unit such that the spout installation edge portion lies substantially horizontal.

As will be apparent from the above, the language of "substantially horizontal" in this disclosure means to include the state in which the spout installation edge portion is tilted within a range of about ±10°.

As mentioned above, in the spout installation method mentioned above, before inserting the spout into the spout installation edge portion of the pouch, the pouch is preliminarily tilted such that the spout installation edge portion lies substantially horizontal. Therefore, at the subsequent steps, by handling the pouch in the tilted state, it becomes possible to attain high-speed processing of installing the spout to the vertical or angled side edge portion of the pouch.

Furthermore, in the spout installation apparatus mentioned above, the pouch reception/delivery unit receives the pouch in a standing state and delivers the pouch to the spout installation unit with the pouch being tilted such that the spout installation edge lies substantially horizontal. Therefore, a conventional spout installation apparatus can be easily utilized by merely changing the pouch reception/delivery unit simple in structure almost without changing the spout installation unit complicate in structure to perform various steps. Therefore, it can be effectively applied especially to a spout installation apparatus employing a rotary type spout installation unit which requires installation of a number of spout installation heads to perform various steps.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those having ordinary skill in the art based on these illustrated embodiments.

Figure 1:
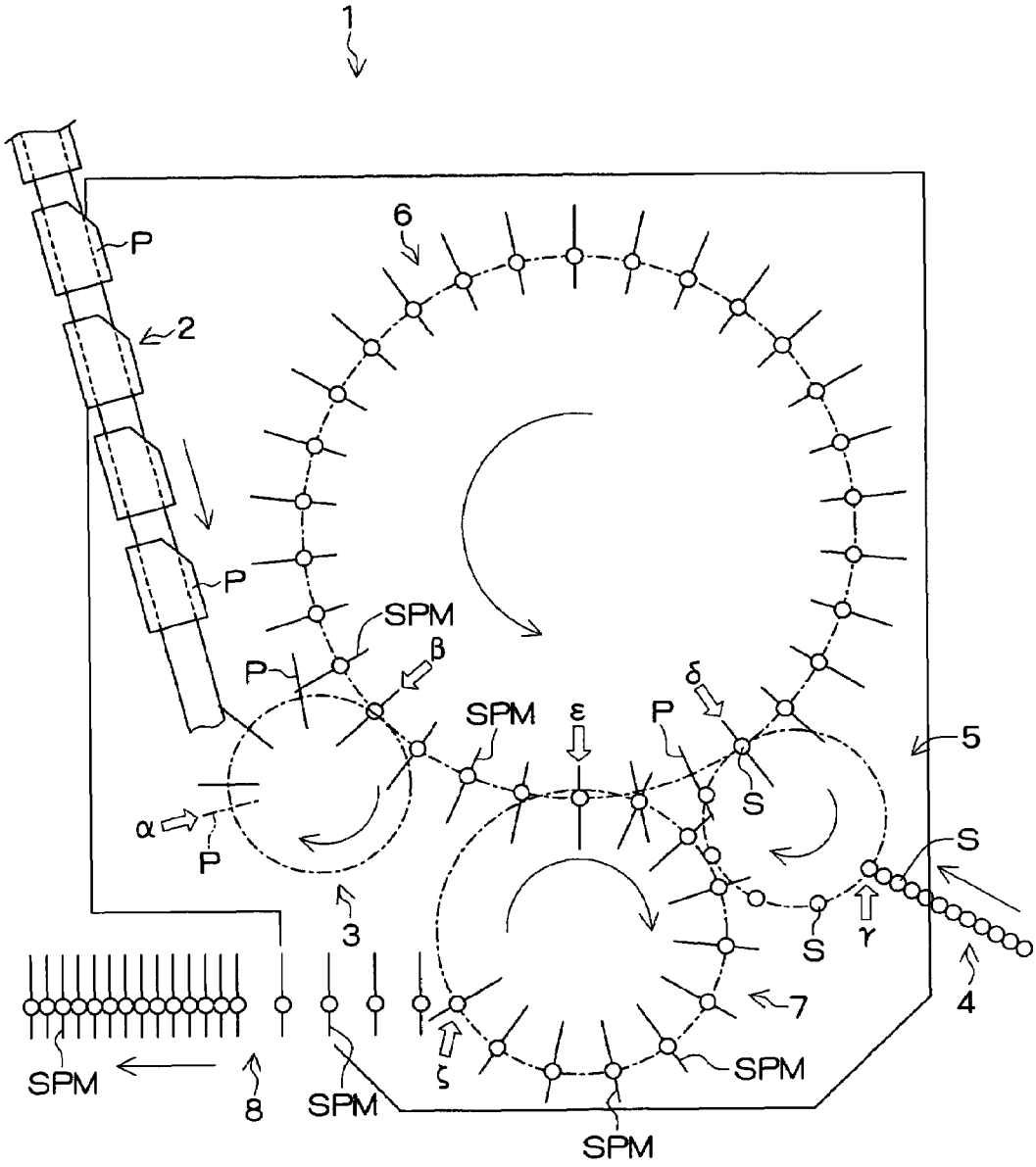
FIG. 1 is a schematic structural view showing an embodiment of a spout installation apparatus according to the present invention.
Figure 9A:
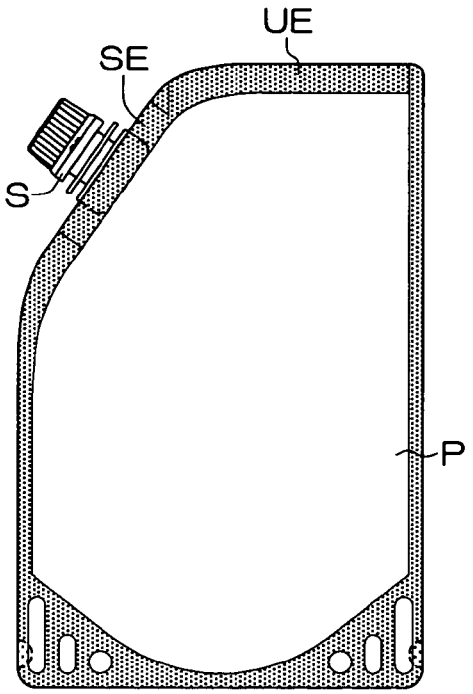
FIG. 9A is a side view showing a pouch container with a spout, in which the spout is installed to an angled side edge portion of the pouch.
Figure 9B:
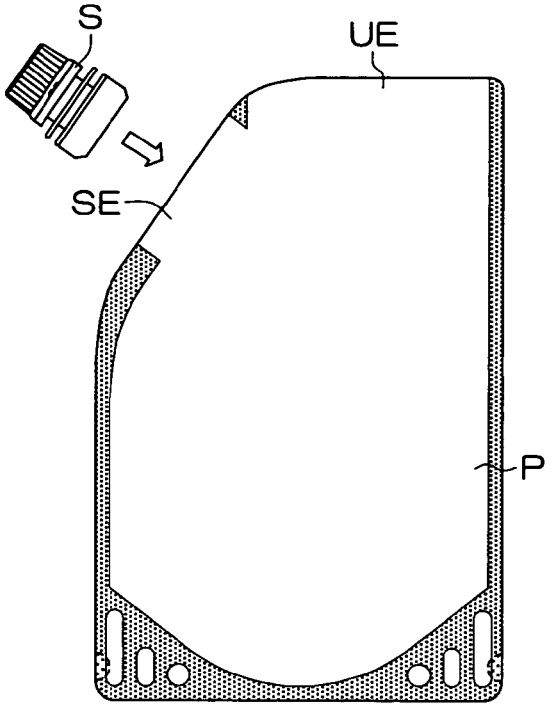
FIG. 9B is an explanatory view of the manufacturing method of the aforementioned pouch container with a spout.
Figure 10:
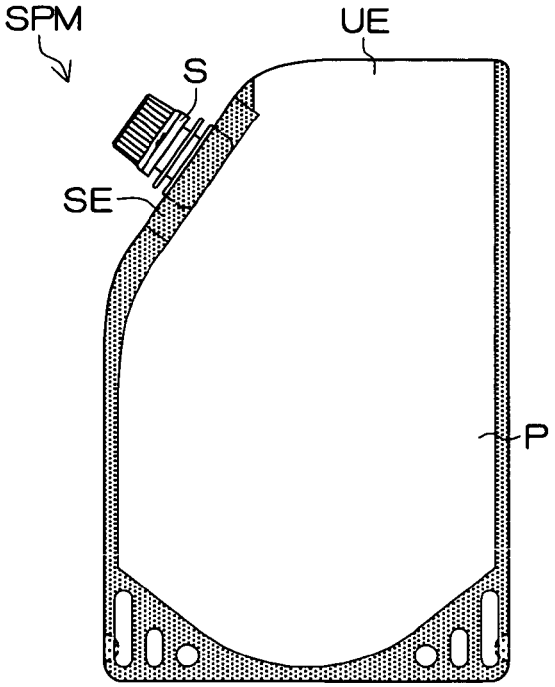
FIG. 10 is a side view showing an example of a pouch container with a spout, manufactured by a spout installation apparatus according to the present invention.

Hereinafter, embodiments of the present invention will be explained with reference to the attached drawings. FIG. 1 shows a spout installation apparatus 1 for forming a pouch container SPM with a spout in which an upper edge portion UE of the pouch P is opened to serve as a filling opening for filling contents as shown in FIG. 10. This is done by installing a spout S to the angled side edge portion SE of the pouch P in which the upper edge portion UE and the angled side edge portion SE are not heat sealed, as shown in FIG. 9B. The pouch container SPM with a spout formed by the spout installation apparatus 1 will be filled up with contents at a post-step, and then the upper edge portion UE of the pouch P forming a filling opening will be heat sealed.

As shown in FIG. 1, this spout installation apparatus 1 includes a pouch supply unit 2 for sequentially supplying a pouch P, in which the upper edge portion UE and the angled side edge portion (spout installation edge portion) SE are not heat sealed to a pouch reception/delivery position α, a rotary type pouch reception/delivery unit 3 for receiving a pouch P supplied to the pouch reception/delivery position α a by the pouch supply unit 2 and conveying it to a pouch reception/delivery position β, a spout supply unit 4 equipped with an air conveyor and a spout feeder for sequentially supplying a spout S to a spout reception/delivery position γ in a standing state, a rotary type spout reception/delivery unit 5 equipped with a number of spout clampers for receiving and conveying the spout S supplied to the spout reception/delivery position γ by the spout supply unit 4 to the spout reception/delivery position δ, a rotary type spout installation unit 6 equipped with a number of spout installation heads for receiving the pouch P conveyed by the pouch reception/delivery unit 3 at a pouch reception/delivery position β, receiving the spout S conveyed by the spout reception/delivery unit 5 at a spout reception/delivery position δ, and installing the spout S to the pouch P while the spout S and the pouch P are being conveyed to a container reception/delivery position ϵ, a rotary type container reception/delivery unit 7 for receiving the pouch container SPM with a spout in which the spout S is installed to the pouch P which was conveyed by the spout installation unit 6 at the container reception/delivery position ϵ and conveying it to a container reception/delivery position ζ, and a container delivery unit 8 for sending out the pouch container SPM with a spout conveyed to the container reception/delivery position ζ by the container reception/delivery unit 7. The spout reception/delivery unit 5 is configured to receive the spout S from the spout supply unit 4 at a position above the pouch P received from the pouch reception/delivery unit 3 and install the spout S to the angled side edge portion SE of the pouch P with the up-and-down relation thereof kept while conveying them.

The spout installation unit 6 includes a spiral structure between the pouch reception/delivery position β and the container reception/delivery position ϵ. The spiral structure is composed of an upper level and a lower level overlapping each other. From the pouch reception/delivery position β to the container reception/delivery position ϵ, the pouch P, delivered by the pouch reception/delivery unit 3 at the pouch reception/delivery position β, is conveyed on the lower level and the pouch, already traveled and installed with the spout S, is conveyed on the upper level.

In the spout installation apparatus 1, the pouch P is delivered to the spout installation unit 6 at the pouch reception/delivery position β. Then, the pouch P is conveyed to pass under container reception/delivery position ϵ which is on the upper level, then to spout reception/delivery position δ, and then over pouch reception/delivery position β which is on the lower level, and then, finally reach the container reception/delivery position ϵ on the upper level. In other words, the pouch P will travel around the spout installation unit 6 more than once.

Figure 2:
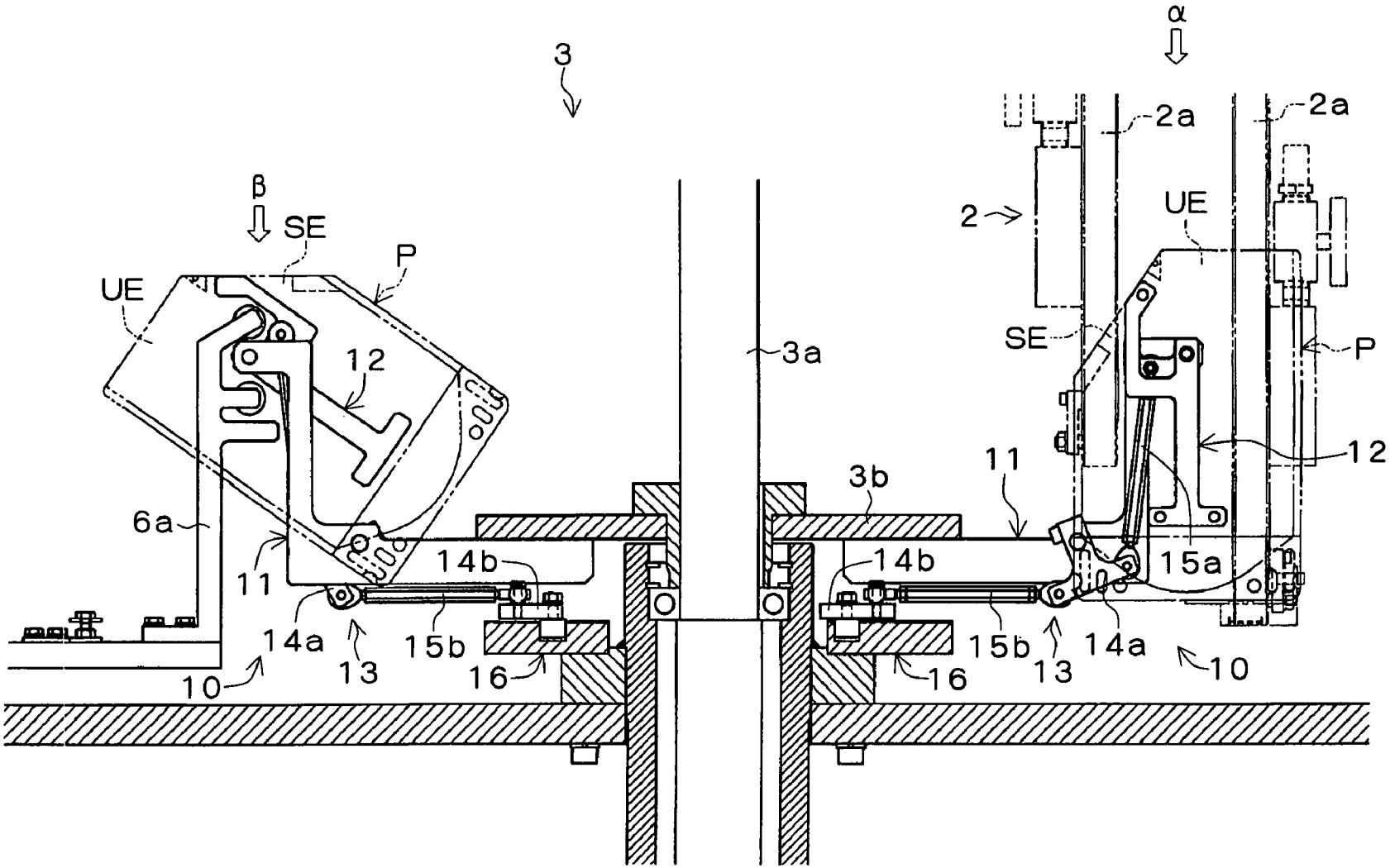
FIG. 2 is a side view showing a pouch reception/delivery unit of the spout installation apparatus.
Figure 3:
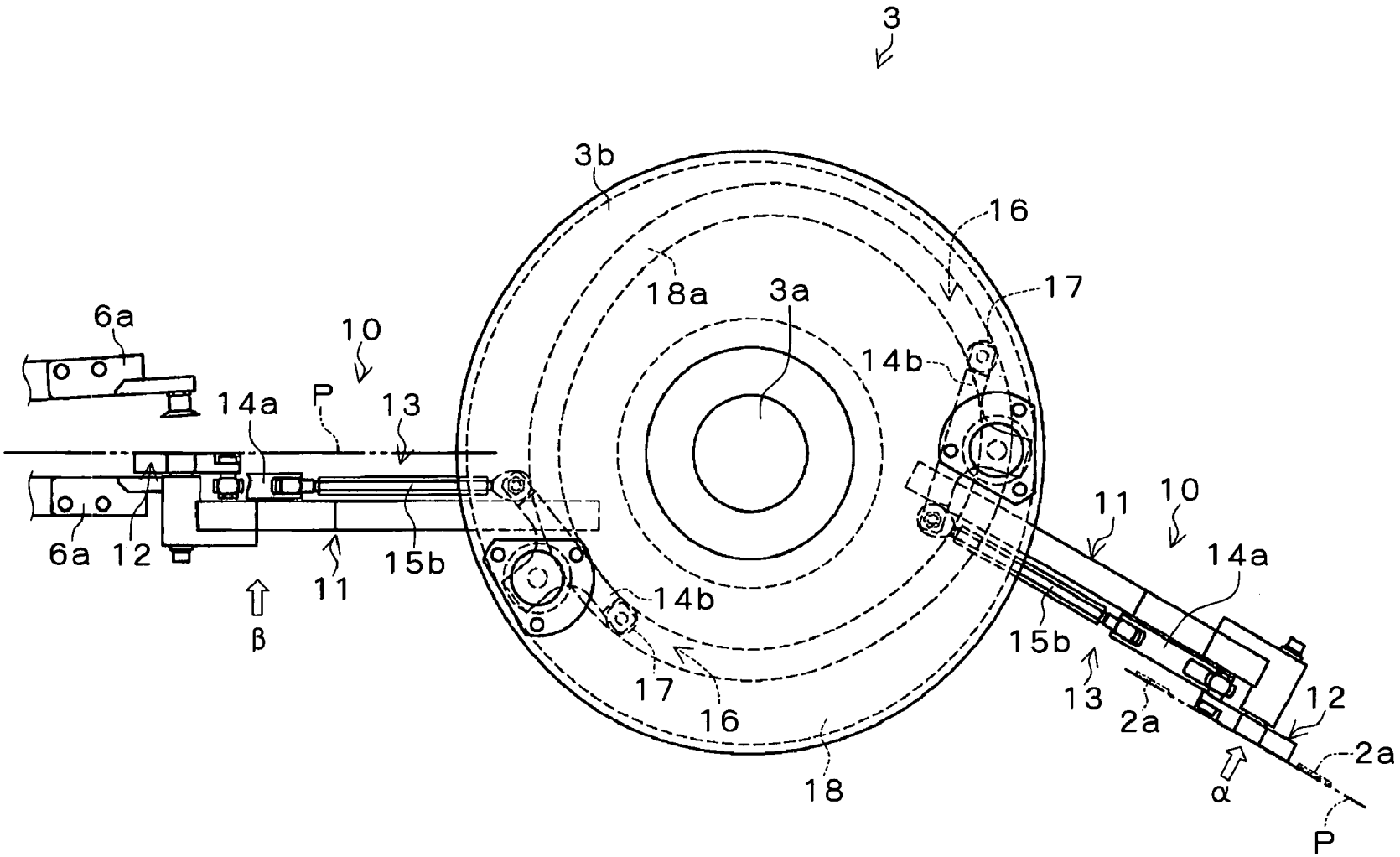
FIG. 3 is a plane view showing the pouch reception/delivery unit of the spout installation apparatus.

As shown in FIGS. 2 and 3, the pouch supply unit 2 is provided with two conveyance belts 2*a* and 2*a* for sucking and holding a pouch P, and configured to supply the pouch P to the pouch reception/delivery position a in a standing state with the non-heat-sealed upper edge portion UE facing upward by delivering the pouch P from a position above the pouch reception/delivery position α to the pouch reception/delivery position α.

As shown in FIGS. 1 to 3, the pouch reception/delivery unit 3 is equipped with a plurality of take-up members 10 which rotate at a constant rotational speed so as to pass through the pouch reception/delivery position α and the pouch reception/delivery position β. The pouch reception/delivery unit 3 receives the pouch P supplied to the pouch reception/delivery position α in a standing state by sucking and holding it by the take-up member 10 and conveys the pouch P to the pouch reception/delivery position β, and then tilts the pouch P, received in a standing state, in the middle of delivering such that the angled spout installation edge portion SE lies horizontal at the pouch reception/delivery position β.

As shown in FIGS. 2 to 4B, the take-up member 10 includes a plurality of rotary arms 11 fixed to a disc-shaped rotary base 3*b* rotating together with a rotary shaft 3*a* in a radially outwardly protruded manner, a suction head 12 swingably supported at the tip end portion of the rotary arm 11 and configured to suck and hold one surface of the pouch P, and a swing mechanism 13 for swing the suction head 12 of each rotary arm 11 at predetermined timing. Please note that FIG. 3 does not illustrate all of the take-up members 10, and only illustrates take-up members 10 located at the pouch reception/delivery positions α and β.

Figure 4A:
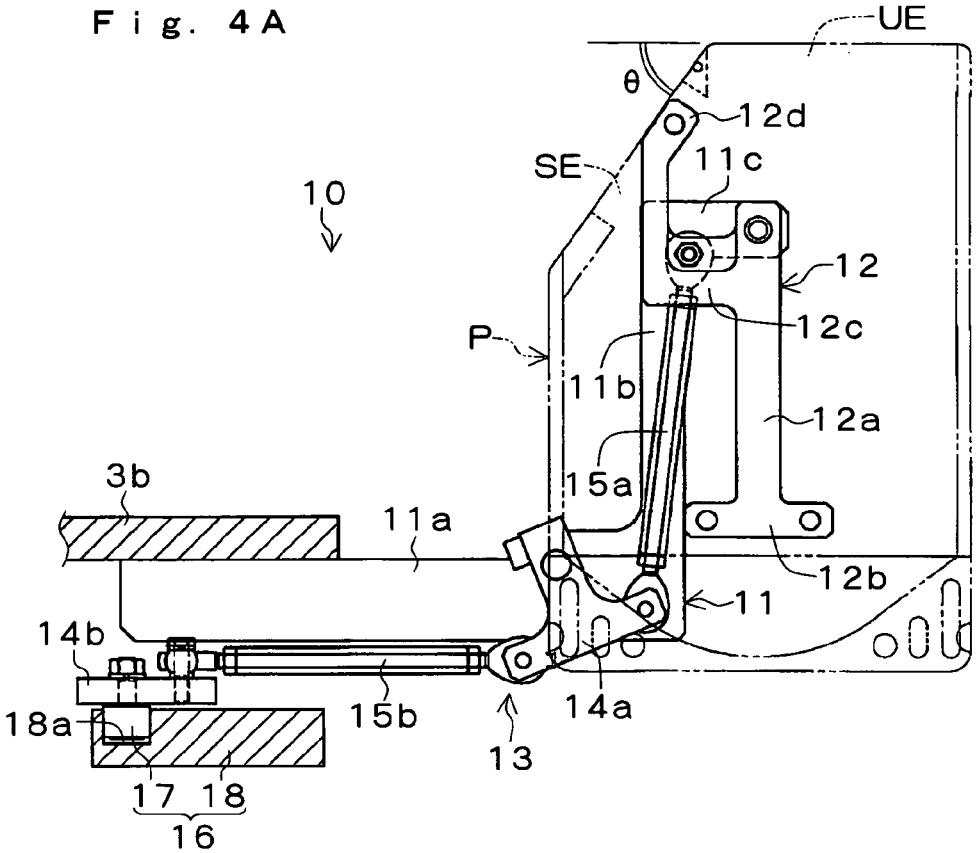
FIG. 4A is an enlarged side view showing a take-up member in the pouch reception/delivery unit of the spout installation apparatus.
Figure 4B:
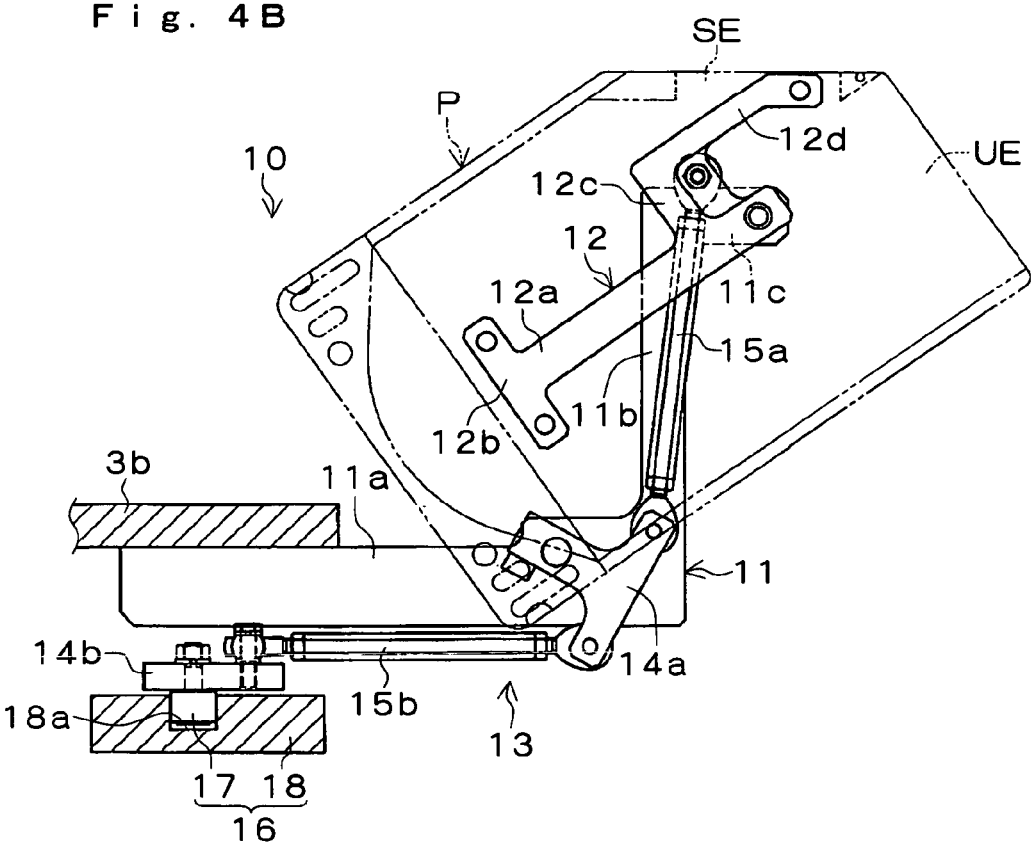
FIG. 4B is an enlarged side view showing the take-up member in the pouch reception/delivery unit of the spout installation apparatus.

As shown in FIGS. 4A and 4B, the rotary arm 11 includes a basal end portion 11*a* supported by the rotary base 3*b*, an intermediate portion 11*b* upwardly extended from the tip of the basal end portion 11*a*, and a tip end portion 11*c* outwardly protruded from the tip of the intermediate portion 11*b*. The suction head 12 is supported by the tip end portion 11*c* of the rotary arm 11.

As shown in FIGS. 4A and 4B, the suction head 12 includes a hanging portion 12*a* hanged from a swing central portion, a first suction portion 12*b* protruded from the lower end of the hanging portion 12*a* inwardly and outwardly in a radial direction of the rotary base 3*b* and configured to suck and hold the bottom portion side of the pouch P at two positions, an overhang portion 12*c* protruded from the vicinity of the swing central portion of the hanging portion 12*a* inwardly in the radial direction of the rotary base 3*b*, a second suction portion 12*d* upwardly extended from the tip end of the overhang portion 12*c* and configured to suck and hold the angled spout installation edge portion SE of the pouch P. The swing central portion of the hanging portion 12*a* is configured to suck and hold the upper portion side of the pouch P.

As shown in FIGS. 2, 3, 4A, and 4B, the swing mechanism 13 includes an inverted T-shaped first swing member 14*a* swingably supported at the tip side of the basal end portion 11*a* of the rotary arm 11, a T-shaped second swing member 14*b* swingably supported by the rotary base 3*b* at the lower side of the rotary base 3*b*, a first link 15*a* connecting one end of the first swing member 14*a* and the overhang portion 12*c* of the suction head 12, a second link 15*b* connecting the other end of the first swing member 14*a* and an end of the second swing member 14*b*, a cam mechanism 16 for advancing and retreating the second link 15*b* in the radial direction of the rotary base 3*b* by swinging the second swing member 14*b*. In accordance with the advance or retreat movement of the second link 15*b* in the radial direction of the rotary base 3*b* with the cam mechanism 16, the first swing member 14*a* swings, causing the advance or retreat movement of the first link 15*a*, resulting in the swing of the suction head 12.

As shown in FIGS. 3, 4A, and 4B, the cam mechanism 16 includes a cam follower 17 rotatably supported at the other end of the second swing member 14*b*, and an annular cam plate 18 having an annular cam groove 18*a* for fitting the cam follower 17 and disposed at the lower side of the rotary base 3*b*. The rotational movement of the take-up member 10 (rotary base 3*b*) about the rotary shaft 3*a* causes a movement of the cam follower 17 along the cam groove 18*a*, which in turn causes advance or retreat movement of the second link 15*b* in the radial direction of the rotary base 3*b*.

Concretely, as shown in FIG. 4A, when the take-up member 10 is located at the pouch reception/delivery position α, the second link 15*b* is in the most retreated state in the radial direction of the rotary base 3*b*. In this state, the hanging portion 12*a* of the suction head 12 is in a vertical state. However, as shown in FIG. 4B, when the take-up member 10 is moved to the pouch reception/delivery position β, the second link 15*b* will take the most advanced position in the radial direction of the rotary base 3*b*, causing the most lifted position of the first link 15*a*, which in turn results in a tilted state of the suction head 12 tilted inwardly in the radial direction of the rotary base 3*b* by an inclination angle θ of the spout installation edge portion SE of the pouch P (see FIG. 4A). Accordingly, the pouch P received with the upper edge portion UE laid horizontal at the pouch reception/delivery position α will be supplied to the pouch reception/delivery position β with the spout installation edge portion SE laid horizontal, and then delivered to the spout installation unit 6.

Each spout installation head mounted to the spout installation unit 6 includes a spout clamper for holding a portion of the spout S between the upper and lower flange portions thereof with a pair of hold arms, a pouch holder for sucking and holding both the front and rear surfaces of the pouch P tilted such that the spout installation edge portion SE takes a horizontal position with a pair of sucking and holding arms 6*a* (see FIGS. 2 and 3) disposed at the lower side of the spout clamper, and a heat sealer having a pair of seal bars disposed between the spout clamper and the pouch holder. The pouch holder receives a pouch P at the pouch reception/delivery position β, and then the spout clamper receives a spout S at the spout reception/delivery position δ. Thereafter, while conveying the spout S clamped with the spout clamper and the pouch P sucked and held by the pouch holder at the lower side of the spout S on the same conveyance line, the spout installation edge portion SE of the pouch P is opened by opening the pair of sucking and holding arms 6*a* sucking and holding both the front and rear surfaces of the pouch P. Thereafter, the spout S is inserted into the opened spout installation edge portion SE of the pouch P by raising the sucking and holding arm 6*a*, and then the spout installation edge portion SE is heat sealed by a heat sealer to thereby install the spout S to the pouch P.

As explained above, in this spout installation apparatus 1, the pouch reception/delivery unit 3 delivers the pouch P, received in a standing state with the upper edge portion UE laid horizontal, to the spout installation unit 6 such that the angled spout installation edge portion SE lies horizontal. Therefore, the spout installation unit 6 can continuously perform installation processing of a spout S to an angled spout installation edge portion SE of a pouch P at a high speed while keeping the tilted state of the pouch P by performing the same processing as the conventional processing.

Especially, the rotary type spout installation unit 6 is required to mount a number of spout installation heads complicated in structure to perform various steps, such as, "receiving of a pouch P," "receiving of a spout S," "opening of a spout installation edge portion SE of the pouch P," "inserting of the spout S into the spout installation edge portion SE," and "heat sealing of the spout installation edge portion SE." In this spout installation apparatus 1, since the pouch P is tilted by the pouch reception/delivery unit 3, almost without changing spout installation heads of a conventional spout installation apparatus for installing a spout to an upper edge portion of a pouch, the conventional spout installation apparatus can be utilized by changing a pouch reception/delivery unit 3 which is simple in structure and few in number of installed take-up members. Therefore, the manufacturing cost of the spout installation apparatus 1 can be kept to the minimum.

In this spout installation apparatus 1, the pouch reception/delivery unit 3 tilts the pouch P toward the rotational center side of the take-up member 10. Therefore, at the time of delivering the pouch P from the pouch reception/delivery unit 3 to the spout installation unit 6, the first suction portion 12*b* of the suction head 12 and the sucking and holding arm 6*a* of the spout installation unit 6 do not interfere with each other, and the bottom portion of the pouch P protrudes outwardly in this spout installation unit 6, resulting in a compact spout installation unit 6.

In the aforementioned embodiment, although the pouch P is tilted such that the spout installation edge portion SE lies horizontal, it is not necessarily required to make the spout installation edge portion horizontal. It is merely required to make the spout installation edge portion substantially horizontal to facilitate the heat sealing operation of the spout installation edge portion and the conveyance operation of the pouch, etc. The allowable angle to a horizontal line falls within the range of about ±10°.

Figure 5A:
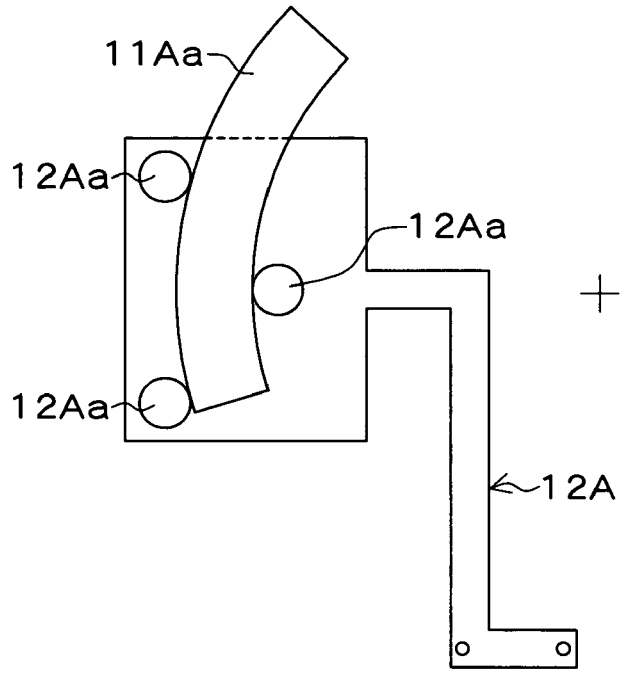
FIG. 5A is a schematic view showing a modification of the take-up member.
Figure 5B:
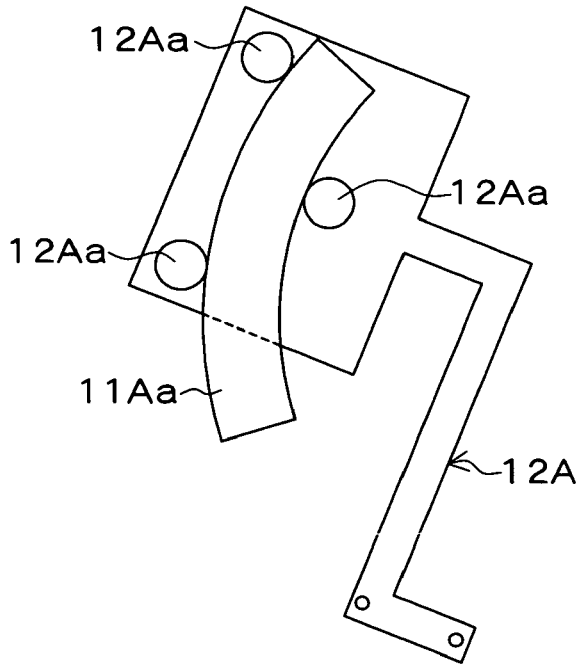
FIG. 5B is a schematic view showing the modification of the take-up member.
Figure 6A:
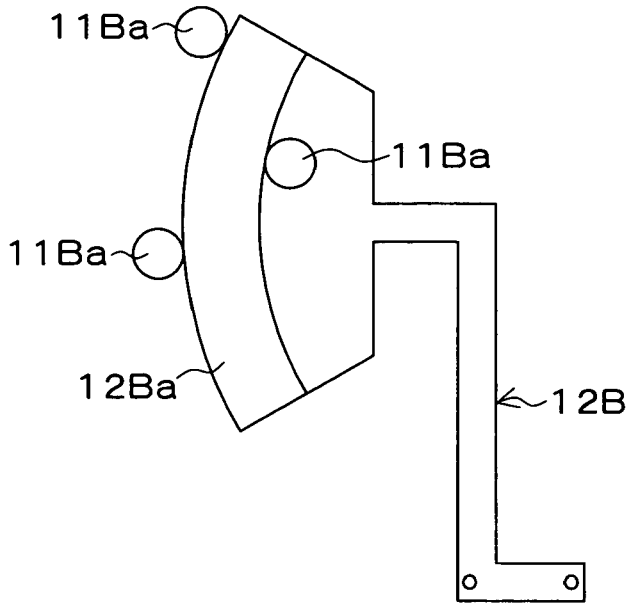
FIG. 6A is a schematic view showing another modification of the take-up member.
Figure 6B:
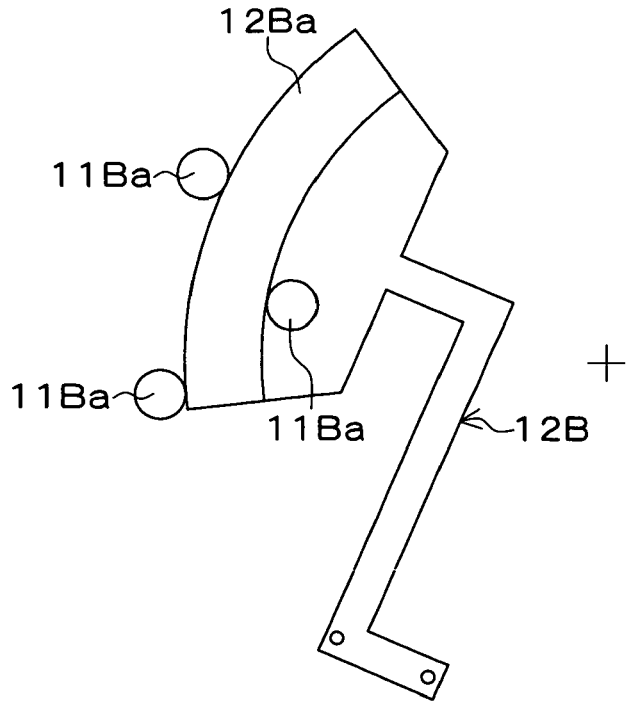
FIG. 6B is a schematic view showing another modification of the take-up member.
Figure 7A:
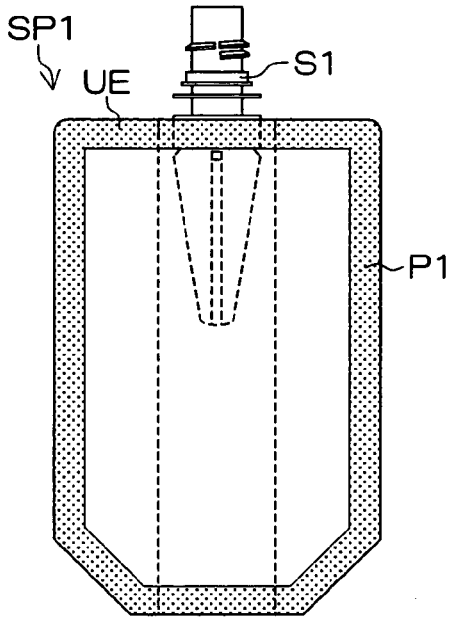
FIG. 7A is a side view showing a pouch container with a spout, in which a spout is installed to an upper edge portion of the pouch.
Figure 7B:
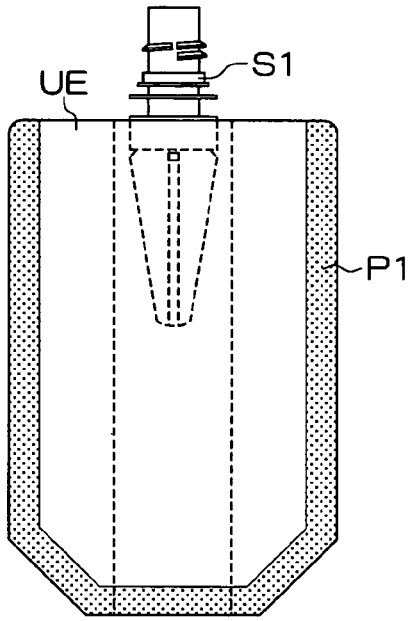
FIG. 7B is an explanatory view of a manufacturing method of the aforementioned pouch container with a spout installed to an upper edge portion of the pouch.
Figure 8:
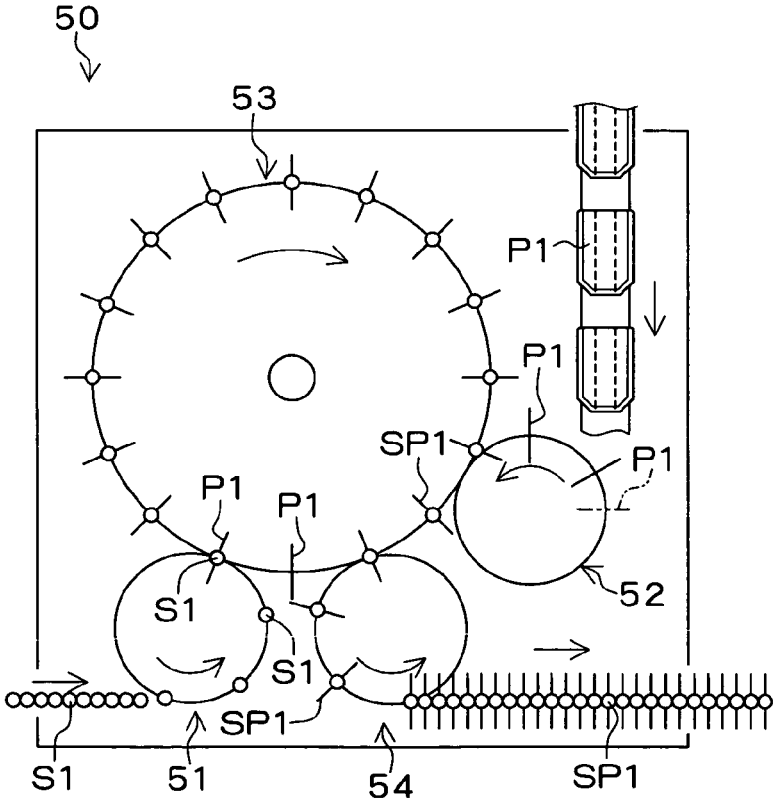
FIG. 8 is a schematic view showing a spout installation apparatus for manufacturing the aforementioned pouch container with a spout installed to an upper edge portion of the pouch.

Furthermore, in the aforementioned embodiment, the rotational center portion of the suction head 12 is supported by the rotary arm 11. Therefore, according to such a structured take-up member 10, at the time of delivering the pouch P to the spout installation unit 6, the rotational center portion of the suction head 12 in a pouch P cannot be held by the sucking and holding arms of the pouch holder. However, as shown in FIGS. 5A and 5B, if it is configured such that a circular guide rail 11A*a* fixed to a rotary arm (not illustrated) are held by a plurality of guide rollers 12A*a* fixed to the suction head 12A so that the suction head 12A can move in a state in which the guide surfaces of the guide rails 11A*a* are guided by and along the plurality of guide rollers 12A*a*, or as shown in FIGS. 6A and 6B, if it is configured such that a circular guide rail 12B*a* formed on the suction head 12B is held by a plurality of guide rollers 11B*a* fixed to a rotary arm (not illustrated) so that the suction head 12B can move in a state in which the circular guide surfaces of the guide rail 12B*a* are guided by and along the plurality of guide rollers 11B*a*, then the rotational center of the suction heads 12A and 12B shown by "+" in FIGS. 5A and 5B and FIGS. 6A and 6B will be free. Accordingly, it becomes possible to hold the rotational center portion of the suction head 12A and 12B in the pouch P by the sucking and holding arms of the pouch holder.

Furthermore, in the aforementioned embodiment, if the suction head 12 constituting the take-up member 10 is not tilted at the pouch reception/delivery position β, the sucking and holding arm of the pouch holder in the spout installation unit 6 and the suction head 12 interfere with each other (see FIG. 2), and therefore, a spout cannot be installed to the upper edge portion of the pouch. However, if the suction head is formed into a configuration which does not interfere with the sucking and holding arm of the pouch holder in a non-tilted state, it can be used not only in the case of installing a spout S to an angled side edge portion SE of a pouch P but also in the case of installing a spout S to an upper edge portion of the pouch P.

In the aforementioned embodiment, it is constituted such that the pouch reception/delivery unit 3 receives the pouch P in standing state with the upper end portion UE laid horizontal and delivers the pouch P to the spout installation unit 6 with the pouch being inclined such that the angled spout installation edge SE lies substantially horizontal. However, the present invention is not limited to the above, and can be constituted such that the spout installation unit 6 receives a pouch in a standing state with the upper edge portion UE laid horizontal and then inclines the pouch P before installing a spout S to the pouch, or the pouch supply unit 2 supplies the pouch P to the pouch reception/delivery unit 3 with the pouch P previously tilted.

Through the aforementioned embodiments, although the explanation is directed to a spout installation apparatus for installing a spout S to an angled side edge portion of a pouch P, the present invention is not limited to the above. Needless to say, the present invention can be applied to the case in which a spout S is installed to a vertical side edge portion of a pouch P (in the case in which a spout is installed to a pouch with the pouch tilted by 90°).

Furthermore, in the aforementioned embodiment, as shown in FIG. 10, a pouch container SPM with a spout having an opened upper edge portion UE serving as a filling opening is formed. However, a spout S can be installed to a pouch P with a heat sealed upper edge portion. In this case, contents can be filled in through the spout S.

The present invention can be applied to a type of a pouch container with a spout in which a spout is installed to a vertical or angled side edge portion of a pouch.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" is meant as a non-specific, general reference and may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

What is claimed is:

1. A spout installation apparatus, comprising:

a pouch supply unit;

a pouch reception/delivery unit; and a spout installation unit, wherein the spout installation apparatus delivers a pouch from the pouch supply unit via the pouch reception/delivery unit to the spout installation unit, the pouch having a spout installation edge portion on a vertical or angled side edge portion where a spout is installed, wherein the spout installation unit installs the spout to the pouch, and wherein the pouch reception/delivery unit receives the pouch in a standing state and delivers the pouch to the spout installation unit with the pouch being tilted such that the spout installation edge portion lies substantially horizontal;

wherein the pouch reception/delivery unit is a rotary type unit equipped with a plurality of take-up members each for holding the pouch, and wherein the take-up member is configured to swing by a swing mechanism as the pouch reception/delivering unit rotates to thereby tilt the pouch held by the take-up member.

2. The spout installation apparatus as recited in claim 1, wherein the spout installation unit is a rotary type unit for installing the spout to the pouch while conveying the pouch with a bottom portion of the pouch protruded radially outward.

3. The spout installation apparatus as recited in claim 1, wherein the pouch reception/delivery unit delivers the pouch held by the take-up member tilted by the swing mechanism to the spout installation unit.

4. The spout installation apparatus as recited in claim 1, wherein said take-up member further comprises:

a rotary arm engaged with said suction head;

wherein said rotary arm is engaged with a swing mechanism which allows the rotary arm to rotate.

5. The spout installation apparatus as recited in claim 4, wherein said take-up member further comprises:

a linkage attaching the swing mechanism to a cam mechanism, such that when said cam mechanism is moved it causes the rotary arm to rotate.

* * * * *